United States Patent [19]

Priesemuth

[11] 4,161,637

[45] Jul. 17, 1979

[54] PUSHBUTTON SWITCH

[76] Inventor: Wolfgang Priesemuth, Wendelbornweg 12, D-2210 Itzehoe-Nordoe, Fed. Rep. of Germany

[21] Appl. No.: 770,827

[22] Filed: Feb. 22, 1977

[30] Foreign Application Priority Data

Feb. 19, 1976 [DE] Fed. Rep. of Germany ..... 2606551

[51] Int. Cl.[2] ..... H01H 3/00

[52] U.S. Cl. ..... 200/153 J; 200/159 R

[58] Field of Search ..... 200/153 J, 159 R, 160, 200/340, 318, 323, 324, 325, 328

[56] References Cited

U.S. PATENT DOCUMENTS

| | | | |
|---|---|---|---|
| 2,946,237 | 7/1960 | Hebert | 200/153 J X |
| 3,542,988 | 11/1970 | Baldasare | 200/153 J X |
| 3,566,705 | 3/1971 | Frydman | 200/153 J X |
| 3,704,353 | 11/1972 | Halla | 200/153 J |
| 3,767,022 | 10/1973 | Olson | 200/159 R X |
| 3,914,570 | 10/1975 | Lockard | 200/153 J |

FOREIGN PATENT DOCUMENTS

| | | | |
|---|---|---|---|
| 1367668 | 6/1964 | France | 200/153 J |
| 2248600 | 10/1973 | France | 200/153 J |
| 1336016 | 11/1973 | United Kingdom | 200/153 J |

*Primary Examiner*—Stanley N. Gilreath
*Attorney, Agent, or Firm*—Becker & Becker, Inc.

[57] ABSTRACT

A pushbutton switch with an actuating bar which has movable switch contacts connected thereto so as to be movable therewith, and is axially movable in a switch housing against the thrust of a return spring. The actuating bar has associated therewith a locking device including a connecting link guide and a guiding pin. When the actuating bar is moved from its starting or rest position into a first switch position, the locking device holds the actuating bar in this first switch position, and when the actuating bar is subsequently actuated, the locking device releases the actuating bar from the first switch position. As a result thereof, the return spring returns the actuating bar to its starting or rest position. The switch also includes stationary switch contacts arranged on the switch housing and operable to be electrically conductively engaged by the movable switch contacts when the actuating bar is in its first switch position. The stationary and movable switch contacts surround the locking device which is located in a longitudinal central plane of the pushbutton switch.

8 Claims, 5 Drawing Figures

FIG.3
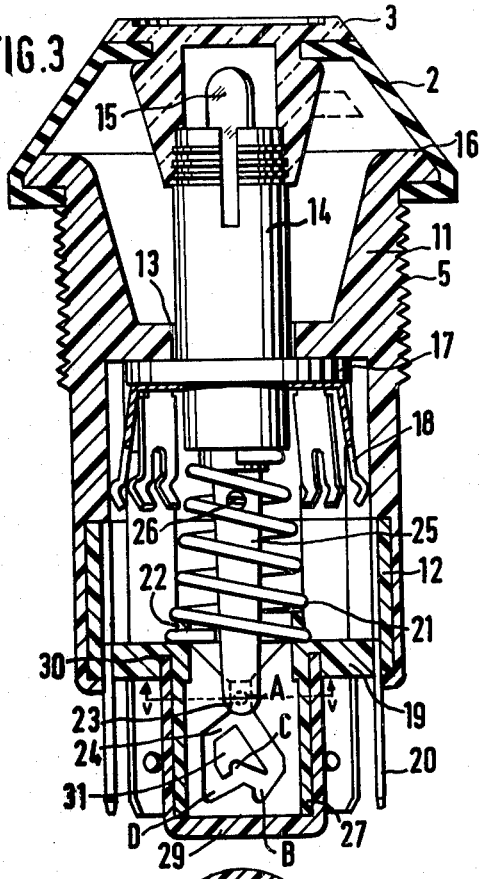
FIG.2
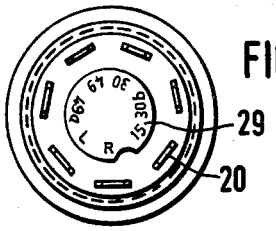
FIG.4
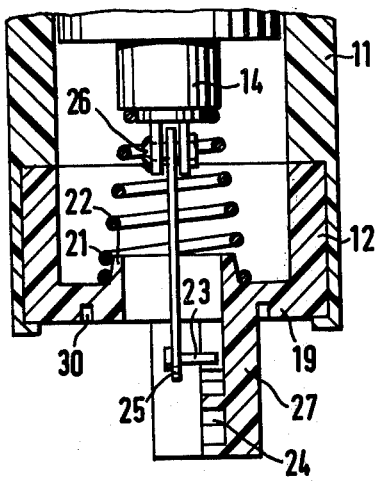
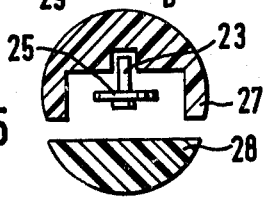
FIG.5
FIG.1
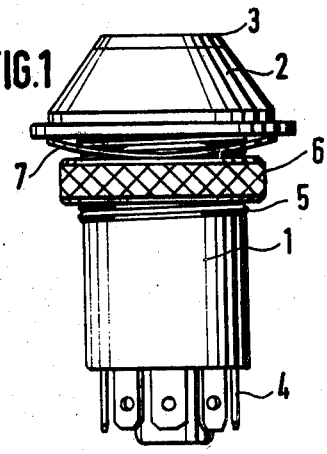

PUSHBUTTON SWITCH

The present invention relates to a pushbutton switch with an actuating bar which carries switch contacts and is axially movable against the thrust of a return spring in the switch housing. More specifically, the invention concerns a pushbutton switch of the just mentioned type which is provided with a locking device which comprises a connecting link guide and a guiding pin and which holds the actuating bar following a first actuation thereof in a first switch position and releases said bar after a subsequent actuation for return to its rest position.

Pushbutton switches designed in the above mentioned manner have heretofore had numerous drawbacks. A first drawback consists in the rather complicated construction, the high finishing costs and the increased sensitivity with regard to disorders, especially if a movably mounted coulisse is involved. Another drawback is seen in the fact that the locking device is generally eccentrically arranged in order to save space required for the switch contacts. With such an arrangement, strong actuating and holding forces occur so that such push-button switch has the tendency to jam.

It is, therefore, an object of the present invention to provide an improved pushbutton switch which will be free from the above mentioned drawbacks, will be extremely safe in operation and can be manufactured at relatively very low costs.

These and other objects and advantages of the invention will appear more clearly from the following specification in connection with the accompanying drawings, in which:

FIG. 1 is a side view of a warning blink pushbutton switch according to the invention.

FIG. 2 represents a bottom view of the switch of FIG. 1.

FIG. 3 represents on a larger scale then FIGS. 1 and 2 an axial longitudinal section through the switch of FIG. 1 with the latter occupying its switched-off position.

FIG. 4 is a partial section corresponding to that of FIG. 3 but offset with regard thereto by 90°, in which position the contacts, the return spring, and the closure cap of the housing extension have been omitted.

FIG. 5 is a cross section along the line V—V of FIG. 3 but shown in exploded position.

The pushbutton switch according to the present invention is characterized primarily in that the movable and fixed switch contacts are arranged on the circumference of the actuating bar and of the switch housing and surround the locking device which is arranged in a longitudinal central plane of the switch. The connecting link guide may be fixedly connected with the housing bottom, and the guiding pin extending in a direction transverse to the connecting link guide may be fixedly connected to the free end of a link which is movable along the longitudinal central plane of the switch and is linked to the inner end of the actuating bar.

According to a preferred embodiment of the invention, for the connecting link guide, on the housing bottom within axially projecting connecting lugs of the contact, there may be provided a housing extension which is divided parallel to the pivoting plane of the link. One section of said housing extension which comprises the connecting link guide forms a portion of the housing bottom, whereas the other section of said housing extension forms the other half of a detachable cover. These two sections of the housing extension may be held together by means of a cup-shaped cap which sealingly engages a circumferential groove of the bottom of the switch housing.

Referring now to the drawing in detail, the blinker pushbutton switch illustrated in FIG. 1 comprises a cylindrical housing 1, a pushbutton 3 sealed by a bellows 2, a connecting lug 4, a connecting nut 6 screwed onto the outer thread 5 of housing 1, and a spring ring disc 7.

The housing 1 has two positively interengaging cup-shaped sections 11 and 12. In the cup-shaped section 11 there is provided a guiding bore 13 for the switch actuating bar 14 which at its outer end is tubular and comprises a control lamp 15 wired within the switch so that a blinker signal emitter feeds the control lamp 15 and all of the blinker lamps. The pushbutton proper 3 is made of transparent material and is positively placed upon the actuating bar 14 or screwed thereon. The end face of the pushbutton 3 thus forms a transparent window through which the light of the control lamp 15 can shine. For purposes of sealing the pushbutton 3, relative to the switch housing 1, there is provided a bellows 2 which engages the push button 3 in an air- and moisture-tight manner. The oppositely located end of the bellows 3 extends around a radial projection or flange 16 of the housing section 11 where it can be clamped in by means of a connecting nut 6 (FIG. 1.).

Below the guiding bore 13 the actuating rod 14 has connected thereto a plate 17 of insulating material which carries the movable switch contacts 18. These movable switch contacts are arranged on the circumference of the plate 17 and are preloaded so as to be urged radially outwardly.

The lower housing section 12 consists of one piece with the housing bottom 19 which is passed through by the contact blades 20. The contact blades 20 form the connecting lugs which axially project beyond the housing bottom and also form the fixed switch contacts which cooperate with the movable switch contacts 18.

As will be evident from FIG. 3, in depressed condition of the pushbutton 3, the actuating rod 14 moves the switch contacts 18 downwardly so that these switch contacts slide off the insulating inner wall of the housing section 11 and then actuate the contact blades 20 therebelow. These contact blades 20 are on one hand guided in the housing bottom 19 and on the other hand rest upon the inner end on an endface of the housing step on the housing section 11. The movable switch contacts 18 have no outer connections. As shown in FIG. 6, the movable switch contacts 18 are combined into groups and bridge the contact blades 20 in pairs or groups.

The return spring 21 which presses the pushbutton 13 outwardly is designed as conical spring which in coaxial alignment is located within the fixed and movable switch contacts 18, 20. The upper counterbearing for the conical pressure spring 21 is located at an inner step of the actuating bar 14. The oppositely located counterbearing is formed by a conical annular bearing 22 located on the inner side of the housing bottom 19.

The locking device proper which holds the pushbutton switch in the turned on position comprises a guiding pin 23 and a connecting link guide 24. The control pin 23 has its free end fixedly connected to a link 25 which at 26 is linked to the inner end of the actuating bar 14. In view of this linkage system, the control pin 23 can move in the drawing plane of FIG. 3 in the inner chamber of return spring 21.

The connecting link guide 24 comprises a second housing extension 27, 28. One section of this housing extension 27 is fixedly connected to the housing bottom 19 and comprises the connecting link guide proper 24. The second section of the housing extension 28 forms a detachable cover which is held by a closure cap 29 which extends over said cover and has a cup shape. The housing cap 29 is concentrically located within the contact blades 20 and by means of its rim sealingly engages a circumferential groove 30 of the housing bottom 19.

As will be seen from FIG. 3, the connecting link guide 24 has an annular guiding path closed in itself.

The pushbutton switch according to the invention operates as follows: when the pushbutton switch occupies its turned off or rest position shown in FIG. 3, the guiding pin 23 occupies a position in the upper apex A of the connecting link guide 24. If the pushbutton 3 is depressed in axial direction into the switch housing 1, the guiding pin 23 advances and hits heart-shaped member 31 of the connecting link guide 24. After the guiding pin 23 has hit the heart-shaped member 31, the guiding pin 23 moves toward the right and downwardly until it finally abuts in position B so that it cannot be moved any farther. This completes the forward stroke of the pressure switch. If now the pushbutton 3 is relieved, the guiding pin 23 moves upwardly until it abuts against the bottom side of the heart-shaped member 31 and then on this inclined surface moves upwardly toward the left until it reaches the position C. Thus, the pushbutton 3 remains in an advanced position which, however, is not the maximum advanced position. Only during the next actuation of the pushbutton 3, the guiding pin 23 can again move downwardly until it abuts the inclined surface at the bottom of the connecting link guide 24 where it moves to the position D. Also here the maximum advanced movement is completed. If now the pushbutton 3 is relieved, the guiding pin 23 can move upwardly and again returns to its switched-off or rest position in which the guiding pin 23 occupies position A.

The switch according to the invention can easily be mounted. In this connection, first the contact bar 14 which carries the contacts 18 is inserted into the housing part 11 from the interior thereof. The link 25 was linked previously to the connecting rod 14. Subsequently, the second housing part 12 may be provided with the contact blades 20. The contact blades 20 engage corresponding recesses of the housing bottom 19. The next working step consists in that conical spring 21 is around the link 25 placed upon the guiding bar 14 whereupon from below the housing section 12 is in a positive manner inserted into the housing section 11. During this insertion, the contact blades 20 will at their inner ends encounter a counterbearing. A dropping out of the contact blades 12 on the housing bottom is prevented by means known per se for instance correspondingly broadened portions above the housing bottom 19. Inasmuch as the housing extension 27 is fixedly connected to the bottom 19, also after assembling the two housing sections 11 and 12, the connecting link guide is fixedly connected to the housing. Now the guiding pin 23 may be so inserted that as shown in FIG. 4, it engages the annular path of the connecting link guide. Subsequently, the cover 28 is deposited and the cup-shaped housing part 29 is slipped thereover. The two housing sections 11 and 12 and the cup-shaped cap 29 may be interconnected by known means for instance arresting lugs and bonding connections. Finally, it is merely necessary to insert the control lamp 15 and to place the cap-shaped pushbutton 3 onto the actuating bar 14 or to screw them on, and to fasten the bellows 2.

The circuit in which the present invention can be used electrically corresponds to FIG. 4 of U.S. Pat. No. 3,600,532—Priesemuth, issued Aug. 17, 1971 and this patent illustrates how with a blinker switch, the seven contact blades are to be connected.

It is, of course, to be understood that the present invention is, by no means, limited to the specific showing in the drawing, but also comprises any modifications within the scope of the appended claims.

What I claim is:

1. A pushbutton switch which includes in combination: a housing, a reciprocable actuating member arranged coaxially within said housing and movable from a first position representing its inactive position to a second position representing its active position, and vice versa, movable switch contacts supported by said actuating member so as to be movable therewith, a locking device associated with said actuating member and comprising a connecting link guide and guiding pin means in engagement with and very accurately guided by said connecting link guide, single spring means operatively connected coaxially to said actuating member and continuously urging the same to said first position, stationary switch contacts arranged on said switch housing, said locking device being operable in response to said actuating member reaching said second position to lock said actuating member in said second position, in which said movable and stationary switch contacts electrically contact each other, said actuating member also being movable out of said second position to allow said spring means to return said actuating member to said first position without any danger of tilting and binding, a link member having one end freely movably linked to said reciprocable member, said housing having a bottom having said contacting link guide fixedly connected thereto, said guiding pin means being connected to the other end of said link member, a divided housing extension extending outwardly from said bottom and arranged inwardly of said stationary switch contacts, one section of said divided housing extension containing said connecting link guide and forming a part of said bottom, and the other section of said extension forming a detachable cover.

2. A switch in combination according to claim 1, in which the dividing plane of said divided housing extends parallel to the pivoting plane of said link member.

3. A switch in combination according to claim 1, which includes a cup-shaped cap connected to said bottom and sealingly holding together said sections of said divided housing extension.

4. A switch in combination according to claim 1, in which said spring means comprises a conical spring resting on one hand against said actuating member and on the other hand resting against said bottom while extending around said link member.

5. A switch in combination according to claim 1, in which that end of said actuating member which is remote from said bottom forms a pushbutton with a light transparent wall, and a control light arranged in said pushbutton.

6. A switch in combination according to claim 5, in which that end portion of said housing which is remote from said bottom has an annular flange and which includes an air-tight elastic bellows sealingly engaging said pushbutton of said actuating member and said annular flange.

7. A switch in combination according to claim 1, in which said housing comprises two axially aligned sections opening toward and positively engaging each other, one of said sections being provided with a guiding bore guiding said actuating member, whereas the other section contains said connecting link guide and said stationary switch contacts.

8. A switch in combination according to claim 1, in which said housing consists of interlocked and bonded together sections of elastic material.

* * * * *